United States Patent [19]

Brunner

[11] Patent Number: 4,714,116

[45] Date of Patent: Dec. 22, 1987

[54] DOWNHOLE SAFETY VALVE OPERABLE BY DIFFERENTIAL PRESSURE

[76] Inventor: Travis J. Brunner, P.O. Box 802, Houma, La. 70361-0802

[21] Appl. No.: 906,165

[22] Filed: Sep. 11, 1986

[51] Int. Cl.[4] ..... E21B 34/06

[52] U.S. Cl. ..... 166/321; 166/324

[58] Field of Search ..... 166/72, 321, 322, 323, 166/324, 328, 336

[56] References Cited

U.S. PATENT DOCUMENTS

| | | | |
|---|---|---|---|
| 3,100,452 | 8/1963 | Grimmer et al. | 166/117.5 |
| 3,844,346 | 10/1974 | Mott | 166/212 |
| 3,860,066 | 1/1975 | Pearce et al. | 166/324 |
| 3,958,633 | 5/1976 | Britch et al. | 166/117.5 |
| 3,970,147 | 7/1976 | Jessup et al. | 166/323 |
| 3,976,136 | 8/1976 | Farley et al. | 166/336 |
| 4,144,937 | 3/1979 | Jackson et al. | 166/336 |
| 4,214,606 | 7/1980 | Deaton et al. | 166/322 |
| 4,325,434 | 4/1982 | Roberts | 166/321 |
| 4,331,315 | 5/1982 | Geison | 166/321 |
| 4,378,931 | 4/1983 | Adams, Jr. | 166/322 |
| 4,407,362 | 10/1983 | Bechthold | 166/117.5 |
| 4,421,174 | 12/1983 | McStravick et al. | 166/321 |
| 4,461,353 | 7/1984 | Vinzant et al. | 166/322 |
| 4,519,576 | 5/1985 | Winegeart | 166/321 |
| 4,520,994 | 6/1985 | DeWald | 166/321 |

OTHER PUBLICATIONS

Halliburton Services-Technical Data Sheet, (pp. 21-24).

*Primary Examiner*—Stephen J. Novosad
*Assistant Examiner*—Terry Lee Melius
*Attorney, Agent, or Firm*—Pravel, Gambrell, Hewitt, Kimball & Krieger

[57] ABSTRACT

An oil well downhole safety valve is operated using annulus pressure. The device includes a tool body having a continuous wall defining a flow bore for conveying liquid, the tool body being adapted to travel through a well annulus as part of a work string. A valve body is slidably mounted within the tool body bore. Annular seals carried on the external surface of the valve body form a seal between the valve body and the continuous wall of the tool body. At least one opening is provided through the tool body for allowing annulus pressure to communicate with the flow bore. A valving member is carried by the valve body and is movable between open flow and closed flow positions for valving the flow of fluid through the flow bore. Piston drives, operated by annulus pressure, move the valving member between open flow and closed flow positions. The apparatus can include a spring carried by the tool body for biasing the valving member to an open flow position. The preferred construction provides opposing pistons of differing surface areas, sealed from each other, but connected by a passive connector and balanced with the spring for predetermined pressure conditions. The valve can be manufactured with different surface areas and spring tension values depending upon the environmental conditions of usage and the pressure and flow conditions of a particular well.

10 Claims, 13 Drawing Figures

DOWNHOLE SAFETY VALVE OPERABLE BY DIFFERENTIAL PRESSURE

BACKGROUND OF THE INVENTION

The present invention relates to oil well downhole safety valves and more particularly to a downhole safety valve wherein opposing pistons of differing surface areas connected by a passive connector and preferably balanced with a spring are used to seal the well when certain predetermined pressure characteristics are experienced in the well.

Even more partiuclarly, the present invention relates to a downhole safety valve device operable by annular pressure which can be used to operate various downhole tools and to perform various downhole functions including drill stem testing, storm choking, downhole valving, and the like.

In the drilling of oil and gas wells, it is common to use an elongated tubular member which is known in the industry as the casing. The bore of the well inside the casing is known as the well annulus. Frequently, a drill or work drill or production string is placed in the annulus and carries down into the well bore any of a number of downhole tools which are used to perform any of a number of functions in the well bore. Some tools are used as part of the drill stem to test the stem for leaks. Oftentimes, the work or tubing string carries a control or safety valve which protects against blowouts or loss of control of the well. The function of such a control or safety valve is to prevent flow upwardly through the tubing string after the valve closes. The use of a safety valve for the purpose of preventing uncontrolled flow from a well through a production tubing is a common procedure. Numerous patents have been issued for downhole safety valves and downhole ball valves which are directed to a solution of the problem of preventing undesired flow from the well. Examples of downhole safety valves which have been patented include the Mott U.S. Pat. No. 3,844,346, the Deaton et al. U.S. Pat. No. 4,214,606, the Roberts U.S. Pat. No. 4,325,434, and the Vinzant et al. U.S. Pat. No. 4,461,353.

The Mott U.S. Pat. No. 3,844,346, entitled "Subsurface Safety Valve Well Tool Operable By Differential Annular Pressure" describes a well tool apparatus that is adapted for connection in a production tubing. The tool includes a separable flow housing having a bore extending therethrough with a rotatable ball bore closure positioned in the bore which is operable in response to differential fluid pressure in an annular area about the tubing.

The Deaton et al. U.S. Pat. No. 4,214,606, entitled "Subsurface Safety Valve" provides a valve assembly for connection in a well pipe, including a valve member disposed in a valve body having a bore or passageway therethrough, a pair of spaced apart and oppositely facing valve seats in surrounding relation to an intermediate portion of the passageway, the valve positioned thereat and operably to open and close the passageway, a space within the valve body outwardly of the passage therethrough, a control frame guidably movable within the space and having a piston associated therewith adapted to define first and second variable capacity pressure chambers within the space. The control frame in movable is opposite longitudinal directions to open and close the valve. Such movement is perfected by using first and second ports, the first port providing fluid communication between the first variable capacity pressure chamber and an external source of pressure fluid. The second port provides fluid communication between the second variable capacity pressure chamber and the passageway through the valve body.

The Roberts U.S. Pat. No. 4,325,434 entitled "Tubing Shutoff Valve" describes a subsea test valve system for a well completed at the floor of the sea and includes a safety valve and a disconnect mechanism mounted in a blowout preventor at the bottom of the sea and having hydraulic fluid operated means for opening the safety valve and controlling a latch in the disconnect system. Subsea hydraulic pressure operated devices are supplied with pressure fluid from a subsea accumulator under the control of subsea pilot valves which are operated by small pressure differences, to accomplish rapid operation at great depth from a control console on a vessel or platform.

The Vinzant et al. U.S. Pat. No. 4,461,353 entitled "Well Safety Valve" describes a safety valve including a ball valve in the central flow passage of the tool body for controlling pumped fluid flow therethrough.

Haliburton Services of Duncan, Okla. has used a subsurface safety valve which is pressure operated. The device is run in the hole and activated upon reaching a desired position by pressure. The Haliburton apparatus used a safety valve which is a sliding valve construction utilizing annulus hydraulic pressure against a chamber of nitrogen to open the tool. This pressure must be maintained to keep the tool open, and reduction of annulus pressure causes the valve to close. An additional feature of the Haliburton device provides for a closure of the valve into a locked closed position if excessive annulus pressure develops while the tool is open. Normally the Haliburton safety valve is located in the test tool string above a packer. The device is actuated with a predetermined pump pressure which is applied to the annulus fluid. Releasing the pump pressure causes the tool to close.

A downhole safety gate valve is shown in U.S. Pat. No. 4,520,994 entitled "Sub-Surface Safety Gate Valve."That patent describes a valve with an elongated body which is generally cylindrical and providing a longitudinally running flow conveying bore. A valve gate is removable within the confines of the valve body between open flow and closed flow positions and includes at least one gear receptive toothed rack. A gear structure rotatably mounted within the valve body engages the toothed rack and moves the toothed rack of the valve gate between open flow and closed flow positions. An operator shaft, carried by and movable within the confines of the elongated valve body, is provided for engagedly rotating the gear structure. A hydraulic attachment on the valve body allows a controlled hydraulic pressure source to move the operator shafts relative to the valve body. As a failsafe closure of the valve structure, the valve is biased to a closed flow position by providing shafts of varying diameters having a smaller cross-sectional size at one end so that if well pressure leaks into the drive chamber and into the space adjacent the shafts, the pressure acts on the shafts of varying diameter to bias the shaft movement toward the closed flow position.

SUMMARY OF THE INVENTION

The present invention provides an improvement over prior art type downhole valves including safety valves and annular pressure valves by providing a downhole safety valve which is operated by opposing pistons of different surface areas, each sealed from each other, but connected by a passive connector and balanced with a spring for predetermined well conditions. The apparatus can function as a stroking device to operate surface and/or subsurface equipment such as downhole tools used in the petroleum, petrochemical industries, as well as in the disposal of hazardous fluid.

Annulus pressure which enters the tool body through spaced apart ports can be applied equally to the two offset pistons to effect a stroke of predetermined length because of differences of piston size and spring value.

BRIEF DESCRIPTION OF THE DRAWINGS

A better understanding of the invention can be had when the detailed description of a preferred embodiment set forth below is considered in conjunction with the drawings, in which.

DETAILED DESCRIPTION OF A PREFERRED EMBODIMENT

Figure 1:
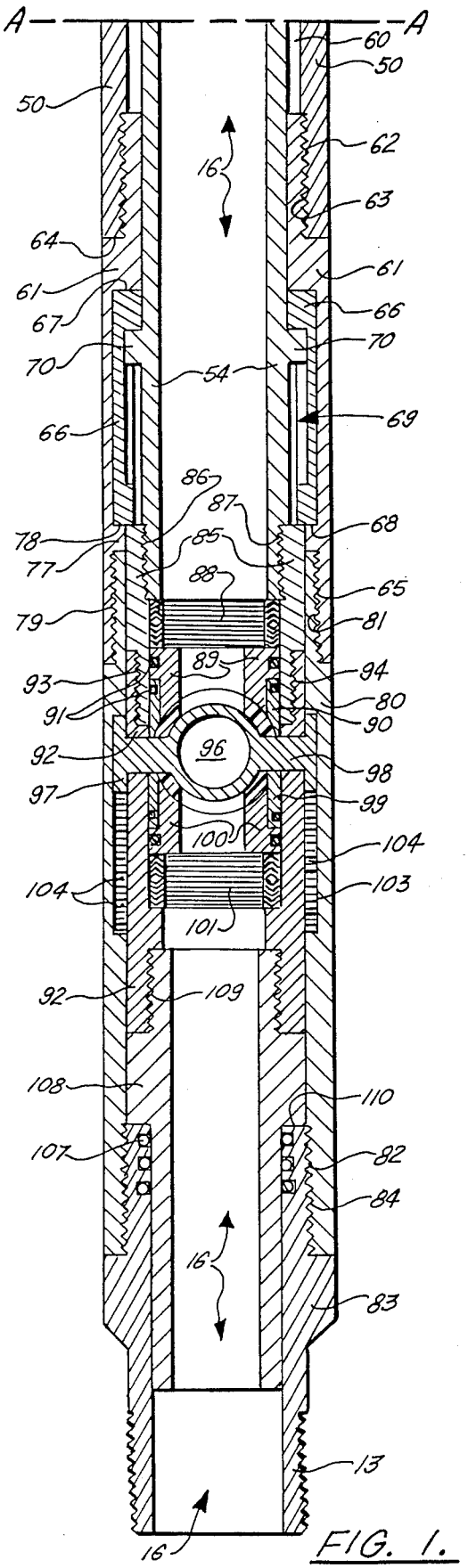
FIG. 1 is a partial, sectional, elevational view of the preferred embodiment of the apparatus of the present invention.
Figure 2:
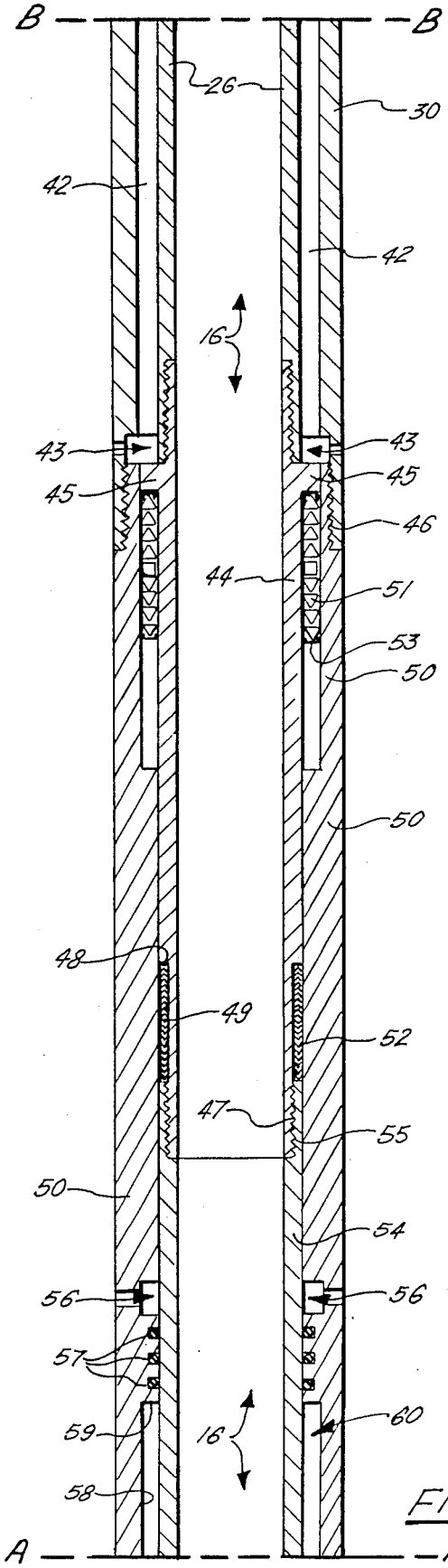
FIG. 2 is another partial, sectional, elevational view of the preferred embodiment of the apparatus of the present invention.
Figure 3:
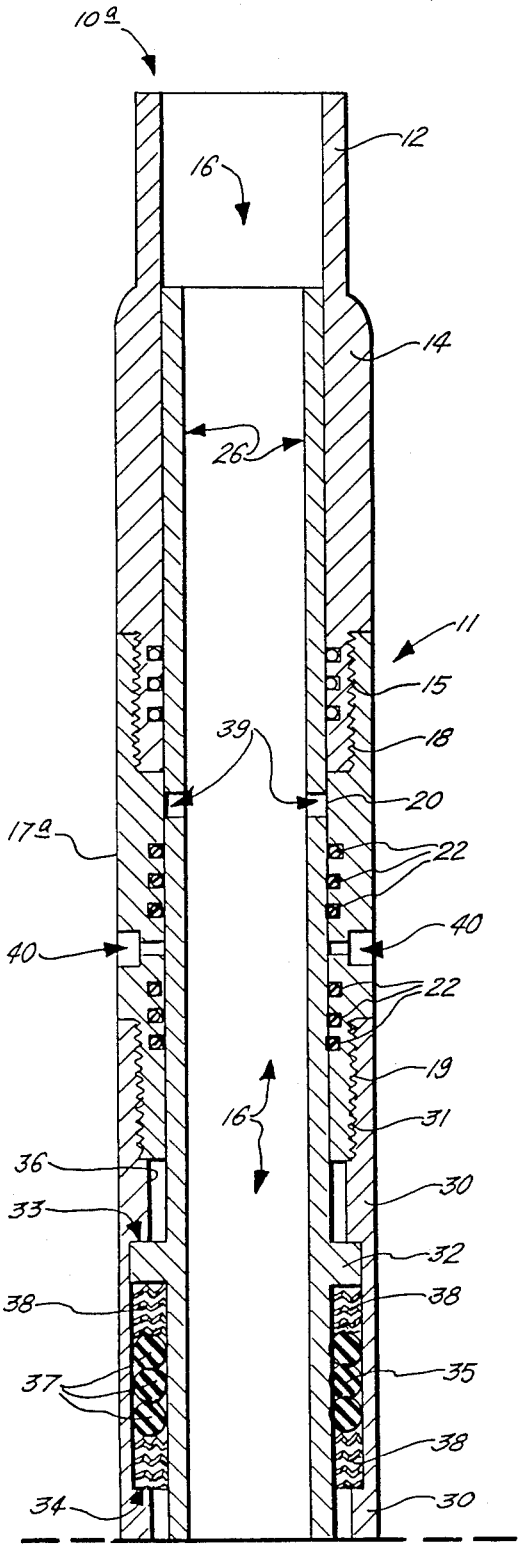
FIGS. 3 and 3A are partial, sectional, elevational views of the preferred embodiment of the apparatus of the present invention illustrating an annular pressure valve (FIG. 3) and a safety valve (FIG. 3A)

FIGS. 1–3 illustrate generally the preferred embodiment of the apparatus of the present invention designated generally by the numeral 10. Differential opposed piston valve mechanism 10 includes an elongated tool body 11 having upper 12 and lower 13 connectors for affixing the tool body 11 in a drill string, work string or production string. The upper connector 12 and lower connector 13 can be conventional threaded connectors typically used in oil and gas well drilling.

The apparatus 10 generally comprises the tool body 11 which is a multi-part body, having a central longitudinal flow bore 16, with a hollow mandrel 26 slideably disposed within the tool body, the mandrel 26 being attached to a sliding power piston 44. The power piston 44 is attached to a lower mandrel section 54. The piston and attached mandrels are powered using well annulus pressure an opposed differential piston area which selectively enters the tool bore through spaced apart pressure ports.

In the embodiments of FIGS. 1–3, the tool body 11 includes multiple, connectible sections including (in sequential order from the top to the bottom of the tool as assembled), upper adapter 14, upper mandrel housing 17, spring housing 30, power piston housing 50, J-lug housing 61, ball housing 80, and lower adapter 83. The tool body 11 includes an upper connector 12 and a lower connector 13, each of which can be threaded, for example, so that the tool body 11 can be attached to a work string, drill string, or the like. Tool body 11 first includes an upper adapter 14 having a threaded section 15 can a central bore 16. Central bore 16, is actually a central longitudinal flow bore which extends from one end to the other end of the tool body 11 so that fluid can flow from upper connector 12 to lower connector 13.

Upper mandrel housing 17 provides upper internal threads 18 and lower external threads 19. The threads 18 form a connection with the threads 15 of adapter 14. Upper mandrel housing 17 provides an inner cylindrical sidewall surface 20 defining a bore 21 which is concentric with bore 16 but which is occupied in part by upper mandrel 26. Seals 22 form a seal between upper mandrel 26 and upper mandrel housing 17. With respect to the embodiment of FIG. 3A, namely the safety valve, an annular lug ring 23 provides a plurality of radially spaced lugs 24 each carrying a projection 25. Upper mandrel 26 provides a plurality of mandrel ports 27 which are receptive of projections 25 for locking the mandrel 26 in a fixed position. Longitudinal mandrel slots 28 are also provided upon mandrel 26 which maintain a radial alignment of lugs 24 during use. An elongated bar 29 can be dropped into or otherwise forced down the drill or work stem to the tool bore 16 for forcing projections 25 laterally away from openings 27 in the event that mandrel 26 is to be moved longitudinally within the tool body 11.

Spring housing 30 includes threads 31 at one end portion thereof which form a threadable connection with the threads 19 of upper mandrel housing 17. An annular ring 32 formed on mandrel 26 is positioned to abut annular shoulder 33 when the mandrel 26 is in its highest position. An internal cylindrical wall surface 35 of bore 16 is larger than the diameter of the internal wall of bore 16 at position 36. The surface 35 thus provides a section of bore 16 occupied by ring 32 during sliding movement of the power piston 44 and mandrel 26. Springs 37 and seals 38 occupy bore 16 at position 35.

In the embodiment of FIG. 3, the safety valve, there are provided a plurality of openings or ports 39 in the upper mandrel 26 and a corresponding plurality of ports 40 in the upper mandrel housing 17A of the safety valve embodiment of the present invention. Upper mandrel 26 includes lower threads 41. Notice that an annular bore 42 is provided between upper mandrel and spring housing 30.

Bore 42 communicates with a plurality of radially spaced ports 43 which are positioned at the connection between spring housing 30 and power piston housing 50. Ports 43 are also positioned above the annular ring 45 of power piston 44. Power piston 44 includes an upper threaded section which threadably engages with a corresponding and interconnecting set of threads provided on the lower end portion of upper mandrel 26. Power piston 44 also provides a lower threaded end portion 47. An annular shoulder 48 defines a reduced diameter section of power piston 44 and thus a piston of reduced surface area when compared to the annular ring 45 which is of a greater surface area. Thus, a reduced outer cylindrical wall portion of power piston 49 is provided which is filled with lower packing seal 52. Another annular shoulder 53 provides an increased internal diameter to power piston housing 50 which is occupied by upper packing seal 51.

A plurality of pressure ports 56 are used to admit annular pressure to act upon the reduced section of power piston 44 and particularly the lower packing 52 thereof and annular shoulder 48. While FIG. 2 of the drawings indicates a relatively tight fit of power piston housing 50 and lower mandrel section 54, it should be understood that approximately twenty-thousandths inches (0.020") of space exists between power piston housing 50 and lower mandrel section 54 so that annular pressure can enter ports 56 and act upon the reduced surface area of power piston 44 at annular shoulder 48 and packing 52. The small spacing between housing 50 and lower mandrel 54 disallows entry of particulate matter into that space. Seals 57 prevent pressure from flowing through ports 56 and into bore 60.

Figure 12:
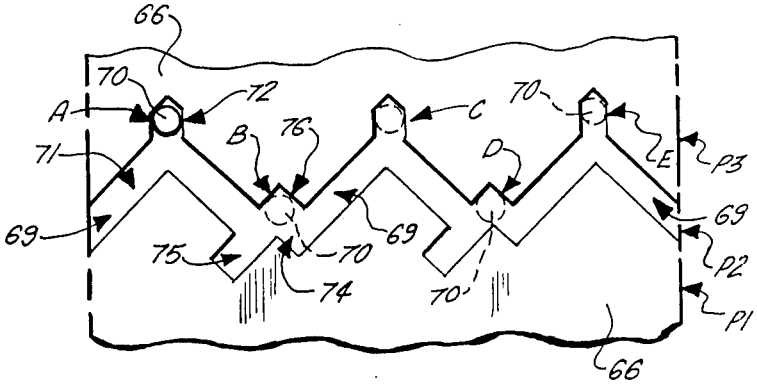
FIG. 12 is a schematic illustration of the J-lug section of the preferred embodiment of the apparatus of the present invention.

Power piston housing 50 includes an internal wall section 58 of increased internal diameter further defined by annular shoulder 59. Power piston housing 60 connects to J-lug housing 61 at a threaded connection formed between the internal threaded section 62 of power piston housing 50 and the external threaded section 63 of J-lug housing 61. J-lug housing 61 includes an annular shoulder 65, and a lower internally threaded section 65. Mounted internally of J-lug housing 61 is J-lug sleeve 66 which abuts annular shoulder 67 and annular shoulder 68 of J-lug housing 61. An elongated slot 69 (see FIG. 12) is formed on the inside of J-lug sleeve 66. Lugs designated as 70 extend outwardly from lower mandrel section 54 and register with the elongated slot 69 of J-lug sleeve 66. During operation, by varying the annular pressure, the lugs are moved within the slot and will thus index the lower mandrel section 54 to desired positions which define open flow and closed flow positions of ball 95. Slot 69 includes diagonal section 71, vertical section 72, diagonal section 73, short diagonal section 74, short diagonal section 65, and then that pattern repeats as shown in FIG. 12. An annular ring 77 on J-lug housing 61 provides an annular shoulder 78 that abuts sleeve 66. J-lug housing 61 includes internally threaded section 80 which threadably engages ball housing 80 and more particularly the externally threaded section 81 thereof as shown in FIG. 1. Ball housing 80 also includes internal threads 82 which threadably engage with lower adapter 83 and more particularly the external threads 84 thereof.

Figure 10:
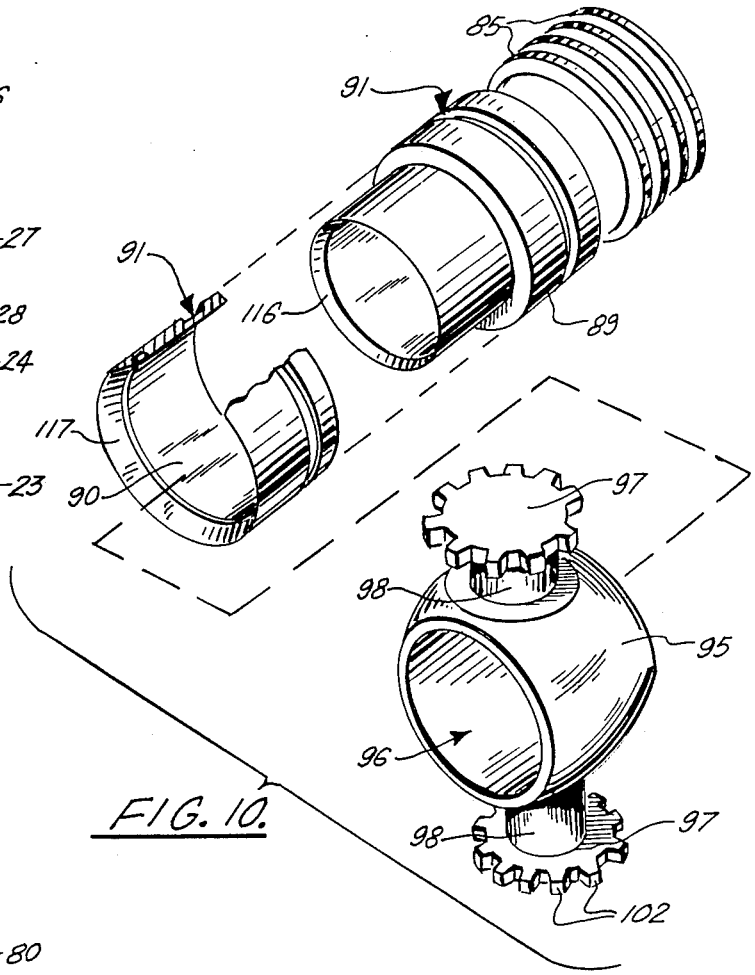
FIG. 10 is a perspective, exploded view of the ball valve portion of the preferred embodiment of the apparatus of the present invention.

An upper ball seat retainer 85 is positioned atop the ball member 90. Upper ball seal retainer 85 includes internal threads 86 and threads 86 connect with the external threads 87 of lower mandrel 54. Springs 88 are positioned between seat 89 and the lower end portion of lower mandrel 54. Springs 88 are used to bias ball seal parts 89, 90 into engagement with ball 95. The seal between ball 95 and seats 89, 90 (above) and 99, 100 (below) is preferably a metal to metal seal. The seats and ball 95 have corresponding matching curvatures at their interface. The upper seat includes seat parts 89 and 90 (see FIG. 10), each having a curved surface 116, 117 respectively which engages the ball 95. O-ring seals form a seal between the seats parts 89, 90 and upper ball seat retainer 85. Ball support sleeve 92 threadably attaches at threaded connection 93 to upper ball seat retainer 85 and more particularly to the threads 94 thereof. Ball 95 (FIGS. 10, 11) has a flow bore 96 which aligns with the longitudinal flow bore 16 of tool body 11 when open. In the position of FIG. 1, however, the bore 96 is transversely positioned with respect to bore 16 and the valve is shown in a closed position. Ball 95 includes a pair of laterally spaced apart rotary gears 97 each having a stem 98 that joins the gear 97 to ball 95. Each rotary gear includes a plurality of teeth 102.

Figure 11:
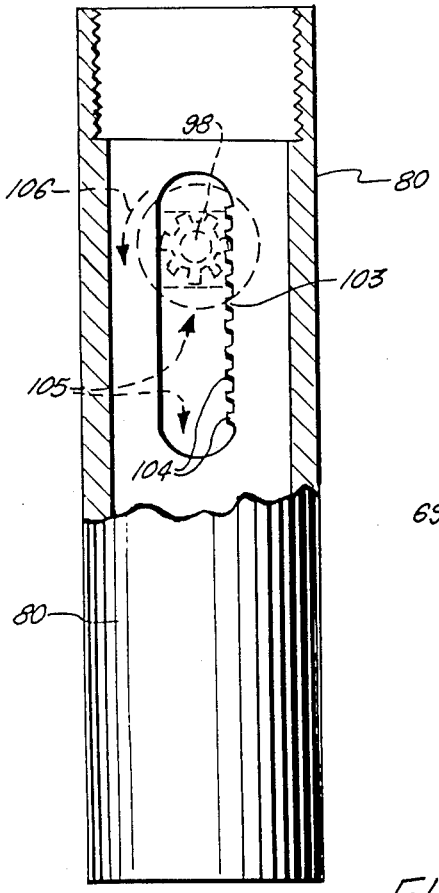
FIG. 11 is a partial, sectional, elevational view of the preferred embodiment of the apparatus of the present invention illustrating the ball valve and rack operator portions.

A lower seat includes parts 99 and 100 which are similarly constructed to the aforedescribed upper seat parts 89, 90. Similarly, the seat parts 99 and 100 are supported by sleeve 92. Springs 101 are used to force the seat parts 99 and 100 into a sealing engagement with the ball 95. The seat parts 89 and 90 of FIG. 100 also show the construction for lower seat parts 99, 10. A rack 103 is formed in ball housing 80 and extends longitudinally (FIG. 11). When lower mandrel 54 and power piston 44 slide within the tool body 11, one skilled in the art will recognize that the linear movement of mandrel 54 with respect to housing 11 will be defined by the vertical movement of lugs 70 within slot 69. Further, as power piston 44 and mandrel 54 move longitudinally within housing 11, such movement carries ball support sleeve 92 and ball 95 with the power piston 44 and mandrel 54. The rotary gears 97 of ball 95 engage the toothed rack 103 of ball housing 80. The teeth 102 of each rotary gear 97 intermesh with the teeth 104 of each rack 103 so that as the piston 44 and mandrel 54 move, a rotation of ball 95 is effected, as shown by the curved arrow 106 in FIG. 11. In short, as the power piston 44 is moved upwardly and downwardly within the tool body11 by using annular pressure introduced at ports 43 and 56, differential piston area at ring 45 (the larger piston surface area) as compared with the area at packing 52 (the smaller piston surface area) causes an opening and closing of the valve ball and thus of the flow bore 16. Slots 105 in ball housing 80 allow stems 98 to protrude therethrough. Lower adapter 83 includes an annular shoulder 107 which defines a stop for mandrel terminus section 108. Section 108 threadably attaches at threaded connection 109 to ball support sleeve 92. Section 108 includes an annular ring 109 having an annular shoulder 110 which extends laterally of the tool bore 16 and register with and abuts against the annular shoulder 107 of lower adapter 83.

In operation, FIG. 12 illustrates the three positions of lugs 70 and thus the three positions of power piston 44 and thus of the valve ball 95 with respect to housing 11. In FIG. 12, an upper position P1 defines the valve as being in a closed flow position. An intermediate position indicated as P2 shows the valve as being in an open flow position. When position P3 is reached, the lugs 70 enter a "kill" position which closes the valve but which prevents any further opening of the valve. The position P3 would normally be reached by elevating the annular pressure to a predetermined higher value which would shear a pin that occupied slot section 75, for example, and thus allow the lug 70 to enter the P3 position. A typical operating pressure in the annulus might be, for example, 1,000 psi. In such a case, the predetermined value to shear the pin could be 1,500 psi. The diagonal section 75 of slot 69 could be, for example, equipped with one or more shear pins which would be broken if annular pressure were elevated to a high enough value, a value which would be predesigned and preselected based upon the size of the shear pin and the metal selected.

Figure 4:
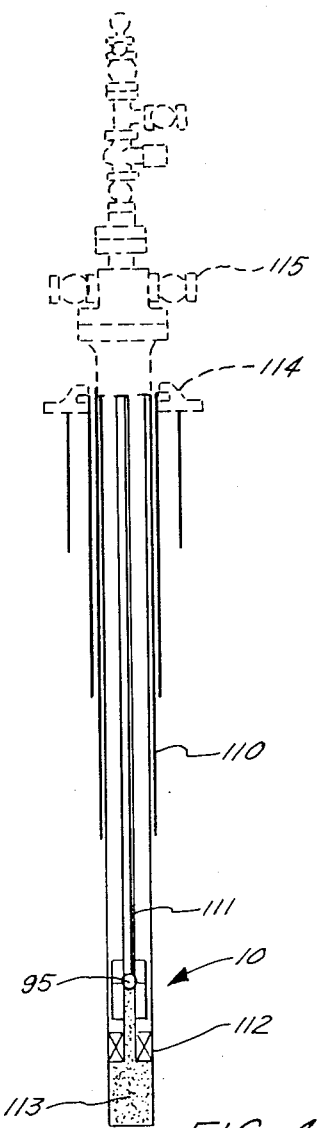
FIG. 4 is a schematic, elevational view illustrating the valve construction of the present invention illustrating a static well with the ball closed.
Figure 8:
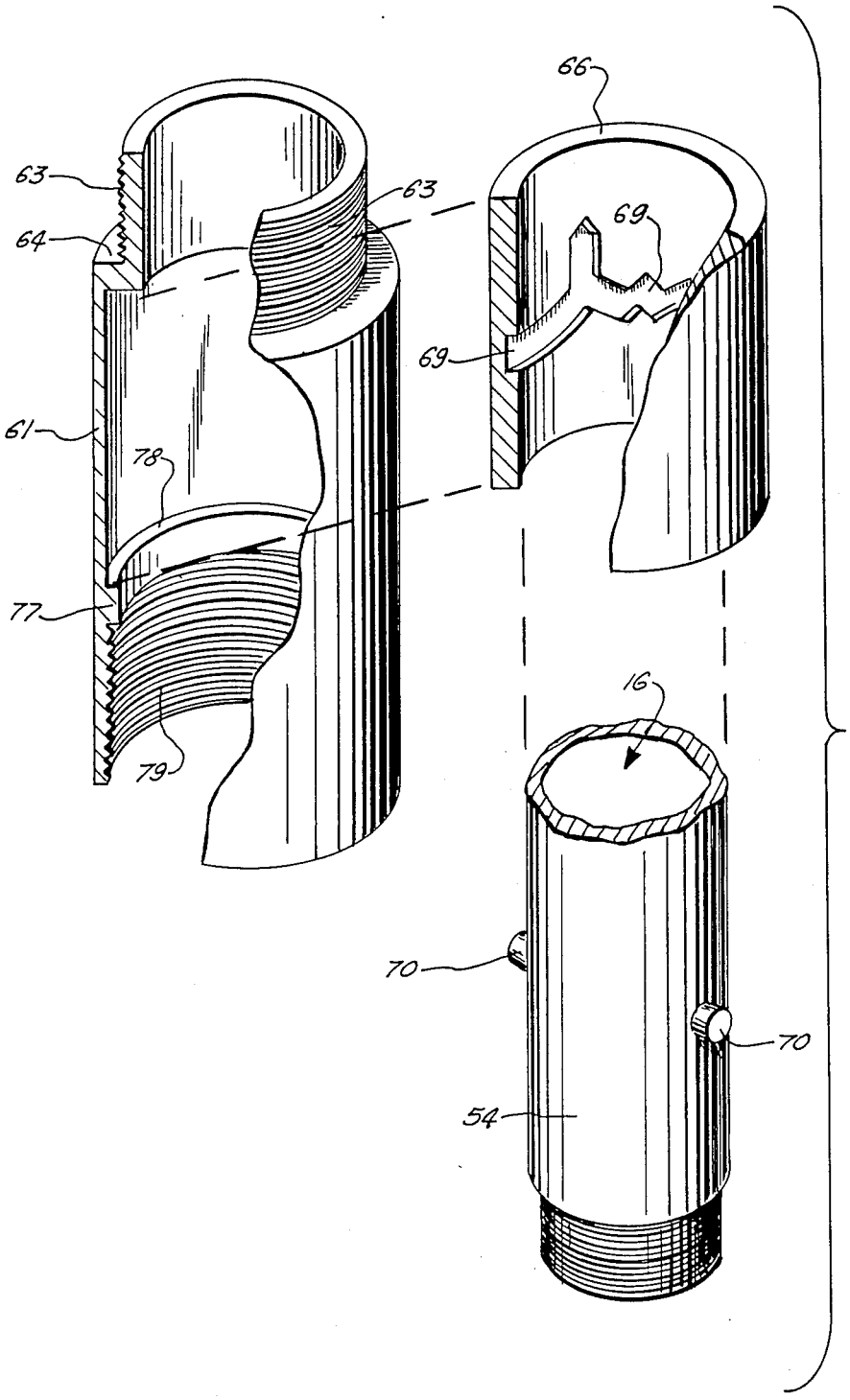
FIG. 8 is a perspective, exploded view of the J-housing section of the preferred embodiment of the apparatus of the present invention.
Figure 9:
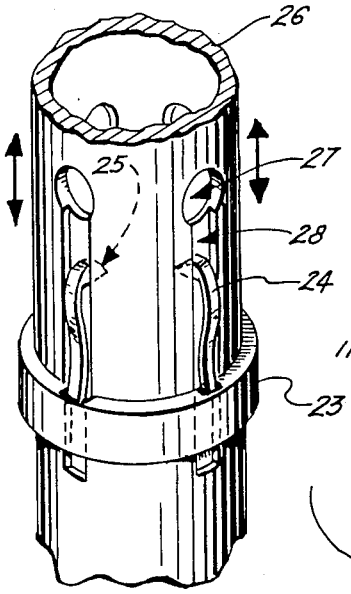
FIG. 9 is a perspective, fragmentary view of the preferred embodiment of the apparatus of the present invention illustrating the locking lug portions thereof.

In FIGS. 4–7, the safety valve of the present invention is shown for purposes of illustration through a sequence. In FIG. 4, the casing is indicated by the numeral 110 and the production tubing by the numeral 111. A packer 112 isolates oil and gas 113 which could also be referred to as the formation fluids. A well head 114 and Christmas tree 115 are also schematically illustrated.

Figure 5:
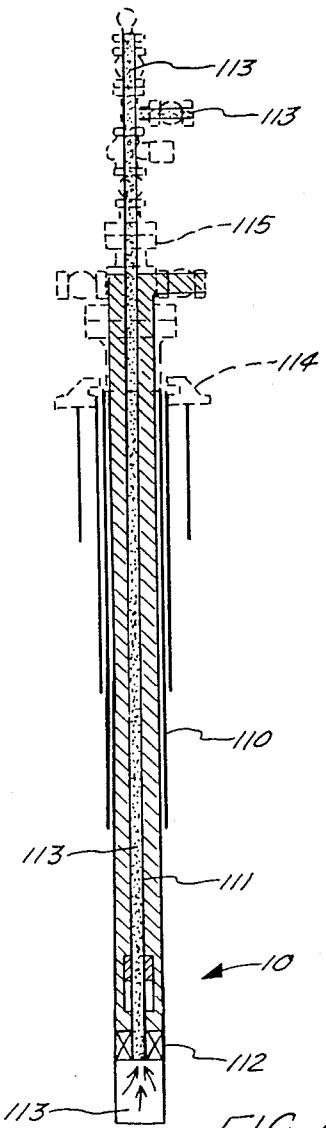
FIG. 5 is another elevational, schematic view of the preferred embodiment of the apparatus of the present invention as used in a well, illustrating a well on production with natural flow through the production tubing.

In FIG. 5, the well is in production, with natural flow being illstrated, the valve 10 in an open position.

Figure 6:
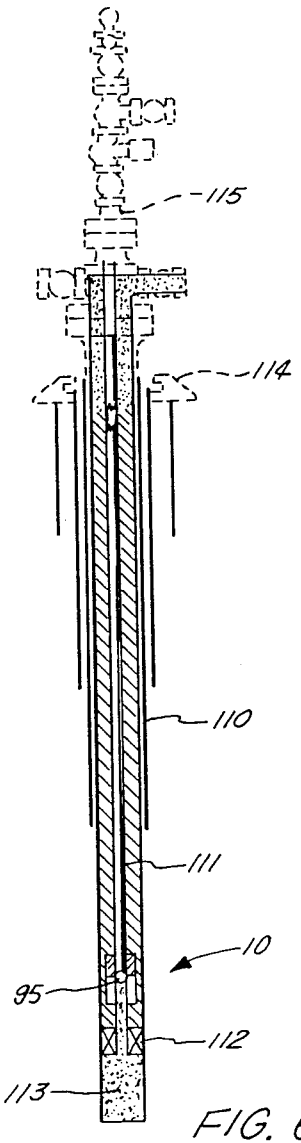
FIG. 6 is another schematic, elevational view of the preferred embodiment of the apparatus of the present invention as used in a well, illustrating a tubing failure with the tubing parted and pressure applied to the annulus and to the power piston.

FIG. 6 illustrates a failure of the tubing, in that the tubing has parted at the position shown as 116. Once the tubing has parted, pressure is applied to the annulus and thus to the power piston 44.

Figure 7:
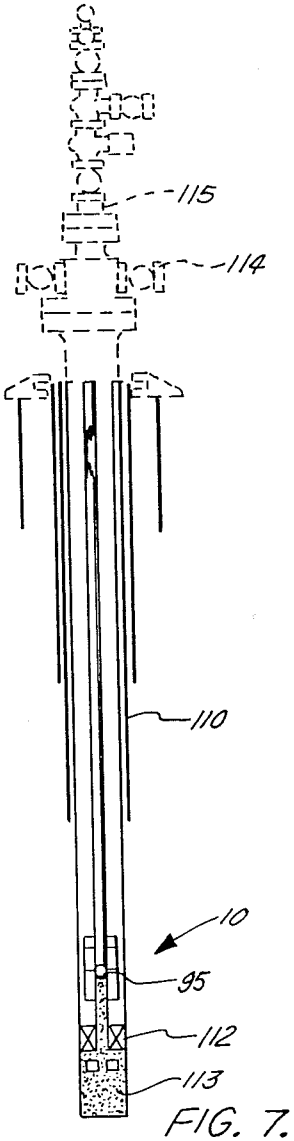
FIG. 7 is another schematic illustration of the preferred embodiment of the apparatus of the present invention illustrating the well in a static condition after the ball has closed.

FIG. 7 shows a completion of the cycle in that the valve has operated to form a closure with the ball preventing the flow of formation fluids 113 up the production string 111.

Figure 3A:
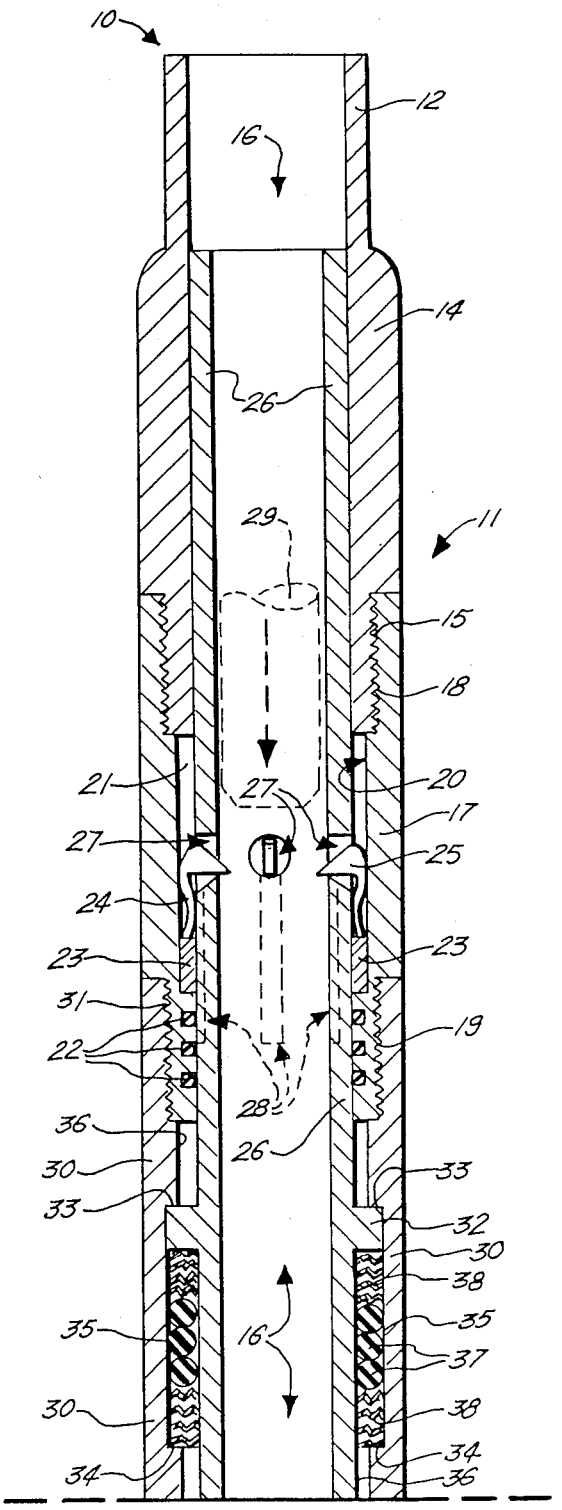

With respect to the embodiment of FIGS. 3 and 3A, it should be understood that the devices shown in FIGS. 3 and 3A function the same with regard to the power piston, ball 95 and with opening and closing of the ball 95 as aforedescribed. The embodiment of FIGS. 3 and 3A are respectively annular pressure valves and safety valves. In the safety valve as above described, the locking lugs are used to lock the valve in a closed position which can only be opened using the slid bar as described. With respect to the annular pressure valve, the locking lugs are not provided but rather, an apparatus is described which has utility in drill stem testing and for reverse circulating. The embodiment of FIG. 3A, the safety valve is primarily a downhole well safety valve apparatus.

The foregoing description of the invention is illustrative and explanatory thereof, and various changes in the size, shape and materials, as well as in the details of the illustrated construction may be made without departing from the spirit of the invention.

What is claimed as invention is:

1. an oil well downhole safety valve operable by downhole annulus pressure, comprising a. a tool body having a continuous [well]wall defining a longitudinal flow bore for conveying liquid, and adapted to travel through a well annulus as part of a work string;

b. a valve body slideably mounted within the tool longitudinal flow bore;

c. seal means carried by the valve body for forming a seal between the valve body and the continuous wall of the tool body;

d. a valving member carried by the valve body for travel therewith and movable between open flow and closed flow positions for valving the flow bore;

e. drive means operative by annulus pressure for moving the valving member between open flow and closed flow positions and comprising a pair of opposing pistons attached to the valve body with drive surfaces of differing surface areas; and f. a pair of openings through the tool body and positioned respectively above and below the pair of pistons, for allowing annulus pressure to communicate with the flow bore and with the piston dirve surfaces so that annulus pressure simultaneously acting upon the piston drive surfaces can move the valving member.

2. The apparatus of claim 1 further comprising spring means carried by the tool body for biasing the valving member to an open flow position.

3. The apparatus of claim 1 wherein there are two openings through the tool body positioned respectively on opposite sides of the seal means.

4. The apparatus of claim 1 wherein the drive means includes a pair of variable diameter piston surfaces positioned on opposite sides of the seal means.

5. The apparatus of claim 1 wherein the drive means includes a valve rotary shaft and a rack engaging the shaft.

6. The apparatus of claim 1 wherein the valving member is a ball valve.

7. The apparatus of claim 1 wherein the valving member moves from the "open flow" to the "closed flow" position responsive to a sliding movement of the valve housing and tool body with respect to each other.

8. The apparatus of claim 5 wherein the valve rotary shaft includes a pinion gear and the drive means includes a toothed rack which engages the pinion gear.

9. The apparatus of claim 1 wherein the valve body has a cross-section corresponding to the cross section of the tool body flow bore.

10. The apparatus of claim 1 wherein the seal means is an annular seal mounted on the external surface of the valve housing and extending toward the tool body continuous wall forming a seal therewith.

* * * * *